US006097309A

United States Patent [19]

Hayes et al.

[11] Patent Number: 6,097,309

[45] Date of Patent: Aug. 1, 2000

[54] REMOTE CONTROL LEARNING SYSTEM AND METHOD USING SIGNAL ENVELOPE PATTERN RECOGNITION

[75] Inventors: Patrick H. Hayes, Mission Viejo; Kimthoa T. Nguyen, Yorba Linda; Khanh Q. Nguyen, Costa Mesa, all of Calif.

[73] Assignee: Universal Electronics Inc., Cypress, Calif.

[21] Appl. No.: 09/121,230

[22] Filed: Jul. 23, 1998

[51] Int. Cl.[7] ..... G08B 7/00

[52] U.S. Cl. ..... 340/825.69; 340/825.07; 340/825.22; 340/825.56; 340/825.57; 348/734

[58] Field of Search ..... 340/825.69, 825.07, 340/825.22, 825.56, 825.57; 348/734

[56] References Cited

U.S. PATENT DOCUMENTS 4,626,848 12/1986 Ehlers .
4,746,919 5/1988 Reitmeier ..... 340/825.56
4,856,081 8/1989 Smith ..... 340/825.57
5,255,313 10/1993 Darbee .
5,519,457 5/1996 Nishigaki et al. ..... 348/734
5,726,645 3/1998 Kamon et al. ..... 340/825.22
5,909,183 6/1999 Borgstahl et al. ..... 340/825.22
5,959,539 9/1999 Adolph et al. ..... 340/825.07

*Primary Examiner*—Brian Zimmerman
*Assistant Examiner*—Yves Dalencourt
*Attorney, Agent, or Firm*—Mark R. Galis; John E. Hyatt

[57] ABSTRACT

A system and method for utilizing receiver signal reconstruction characteristics, in combination with a knowledge of code formats being used, to enable a remote control device to learn the coding format of devices operating at high carrier frequencies even though the carrier frequencies cannot be directly measured.

28 Claims, 4 Drawing Sheets

REMOTE CONTROL LEARNING SYSTEM AND METHOD USING SIGNAL ENVELOPE PATTERN RECOGNITION

BACKGROUND OF THE INVENTION

Most manufacturers of televisions (TVs), video cassette recorders (VCRs) and other consumer electronic equipment provide remote control devices to control their equipment. Equipment of different manufacturers are usually controlled with different remote control devices. To minimize the number of individual remote control devices a given user requires, universal remote control devices have been developed which must be set-up to control various functions of a user's television, VCR, and other electronic equipment. A first method of setting up a universal remote control device requires the user to enter codes into the remote device that correspond and conform to the makes and models of the various equipment to be controlled. This type of method is commonly utilized in conjunction with so-called preprogrammed universal remote controls. In a second method of setting up a universal remote control device, codes that are to be learned by the remote control device are communicated to the remote control device from the equipment or unit to be controlled. Detailed descriptions of universal remote control systems utilizing such set-up methods can be found in U.S. Pat. No. 5,255,313 issued to Paul V. Darbee and in U.S. Pat. No. 4,626,848 issued to Ehlers.

The processes and algorithms used for teaching remote control devices to control these functions are well known in the art. Hence, the learning and teaching process utilized by a learning type universal remote control will be discussed herein only to the extent necessary for the understanding of the invention.

SUMMARY OF THE INVENTION

The subject invention utilizes receiver signal reconstruction characteristics, in combination with a knowledge of the code formats being used, to enable a remote control device to learn the coding format of devices operating at high carrier frequencies even though the carrier frequencies cannot be directly measured.

The foregoing features and advantages of the present invention will be apparent from the following more particular description of the invention. The accompanying drawings, listed hereinbelow, are useful in explaining the invention.

DESCRIPTION OF THE INVENTION

Figure 1:
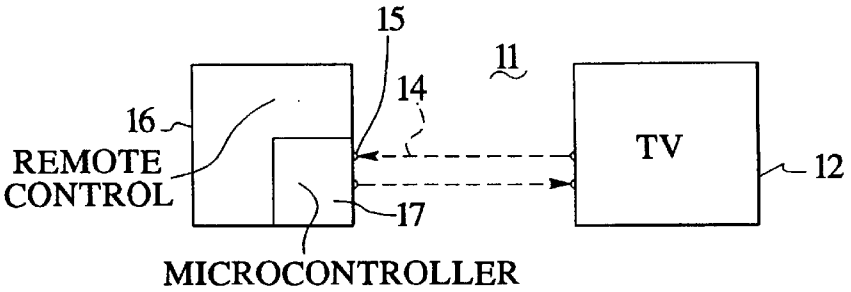
FIG. 1 is block diagram depicting a remote control device communicating with a television.
Figure 2:
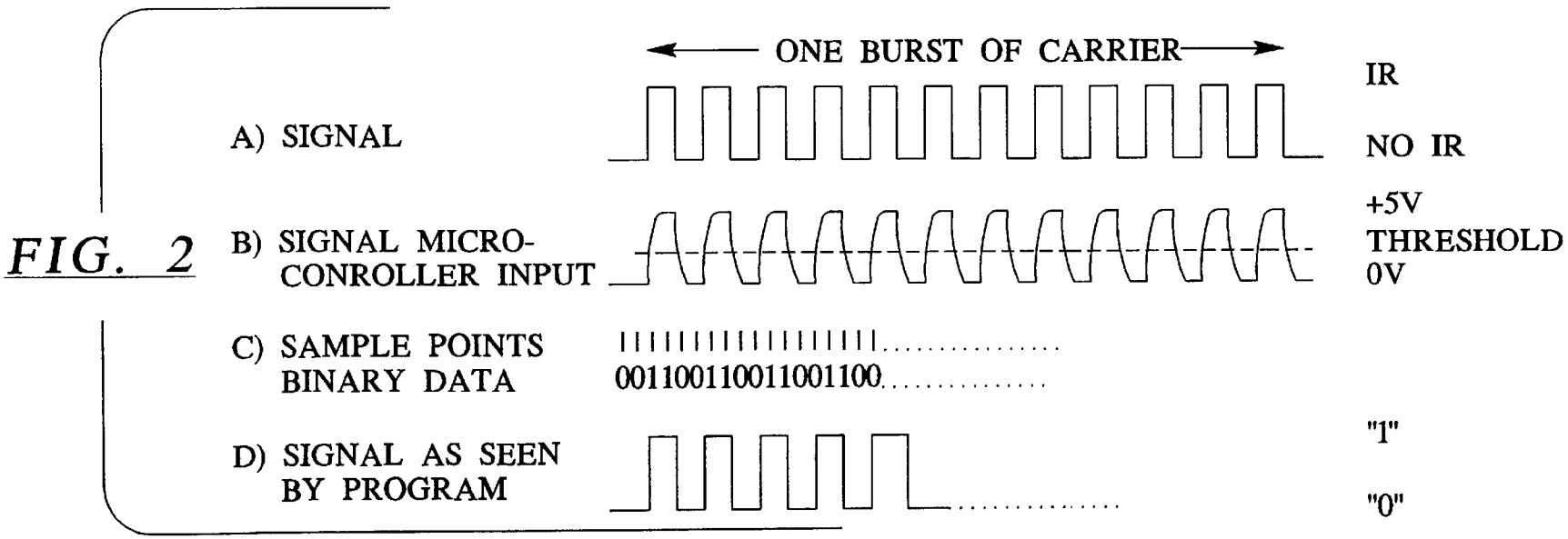
FIG. 2 shows wave forms of a typical IR signal transmitted from a device to be controlled, such as a television, to a remote control device.
Figure 3:
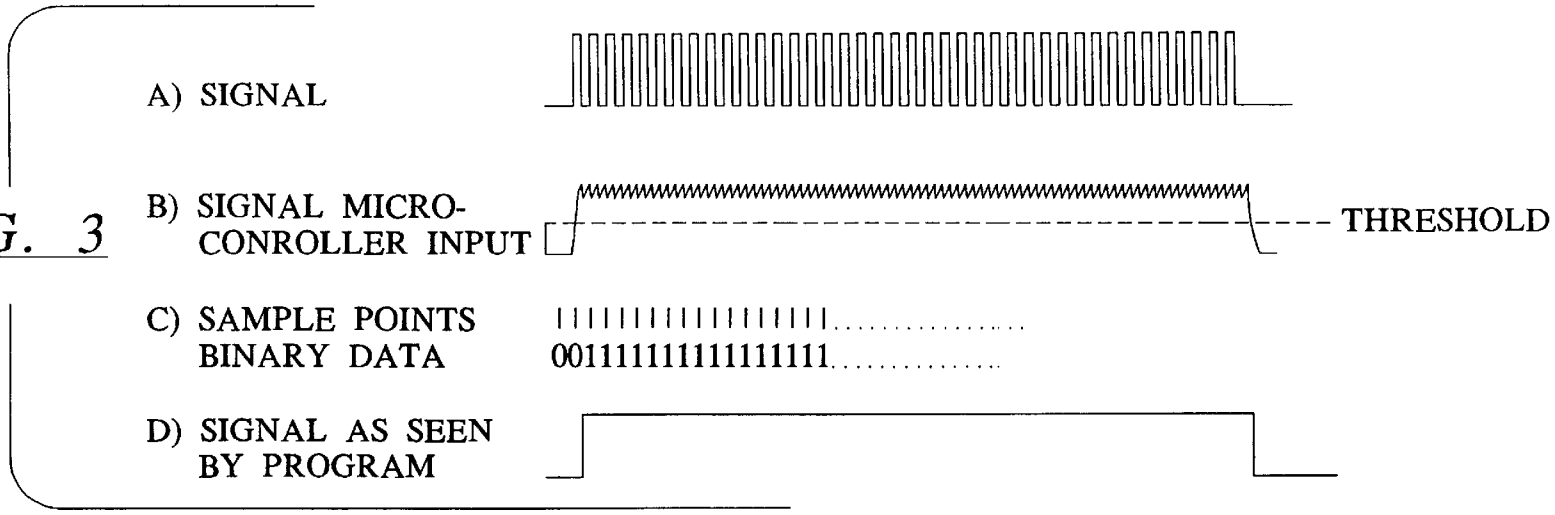
FIG. 3 shows wave forms of a high frequency carrier signal transmitted such as from a television to a standard receiver in a remote control device.

Referring now to FIGS. 1–4, a brief description of the drawing figures is included hereinbelow. As depicted in the block diagram of the inventive system 11 shown in FIG. 1, the signal or code to be learned is transmitted, as indicated by dotted lines 14, from a particular remote control unit 12 of the electronic device to be controlled (TV, VCR or other equipment) to an infrared (OR) detector 15 in the remote control device 16 which device has to "learn" the proper codes to control that particular equipment. The IR to be learned is transmitted to the detector, amplified and applied to an input of a microcontroller (microprocessor) 17 in the remote control device 16. As shown in FIG. 2, since the response time of the electrical circuitry in remote control device 16 is limited, the originally transmitted signal shown as a square wave in FIG. 2A is actually presented at the microcontroller input 17 as shown in FIG. 2B; that is, the signal is distorted and is not an exact replica of the original signal.

The waveform of the transmitted signal as shown in FIG. 2A is typical. As the voltage level applied to the microcontroller input shifts up and down, the logic value of this input as measured by the software in the microcontroller 17 will shift back and forth between a one (1) and a zero (0). This shift is determined by the range about a threshold level, as indicted in FIG. 2B. The precise value of the range and threshold level, which may also include hysteresis, is a characteristic of the particular microcontroller being used. At the sampling points, indicated as FIG. 2C, the binary state (1 or 0) of the input is sampled and stored. This stored data can then be used to replicate the sampled signal as shown in FIG. 2D.

The software program in the microcontroller 17 can monitor the logic state of this input either by repetitive sampling, or by using a suitable microcontroller hardware interrupt feature to recognize each time the input changes state. For simplicity, only the repetitive sampling method is described herein; however, the interrupt method offers similar results, and may be used interchangeably for the purposes described.

The signal (FIG. 2A) is transmitted as burst of a carrier square (rectangular) pulses, the corresponding signal received by the microprocessor input is distorted as shown in FIG. 2B, the reconstructed signal as seen by the microcontroller 17 program is shown in FIG. 2D, and the resulting binary data is indicated at FIG. 2C. Thus, even though some delay and/or distortion of the original signal is introduced in the process, the "learning" software algorithm is still able to accurately ascertain the frequency of the original signal by counting the number of binary transitions (shifts) per unit time. The carrier frequency information, together with the duration of each burst and of the gaps between them then is used to form the definition of the code to be learned.

The majority of infrared remote control code formats use carrier frequencies under 100KHz, well within the capabilities of inexpensive IR receiver hardware and standard-speed microcontrollers to process the signal in the manner described above. However, there are a number of codes which use carrier frequencies above this range, as high as 400 KHz to 1 MHz. These codes using the higher carrier frequencies cause a problem to a "learner" remote control device 16 for two reasons.

First, the inexpensive receiver circuitry contained in the remote control device 16 which is suitable for use at the lower carrier frequencies does not usually have a rapid enough response time to accurately track these higher frequency signals. This is because the high frequency signal shown in FIG. 3A changes state faster than the receiver circuit can follow. The resultant signal at the microcontroller 17 input is shown in FIG. 3B, and this signal may never swing down from the high level of the threshold. The software will detect no binary transition and will deduce that the input is a baseband as shown in FIG. 3D; that is, there is no carrier burst. The result will be no binary transitions and no coding, this is indicated in FIG. 3C.

Figure 4:
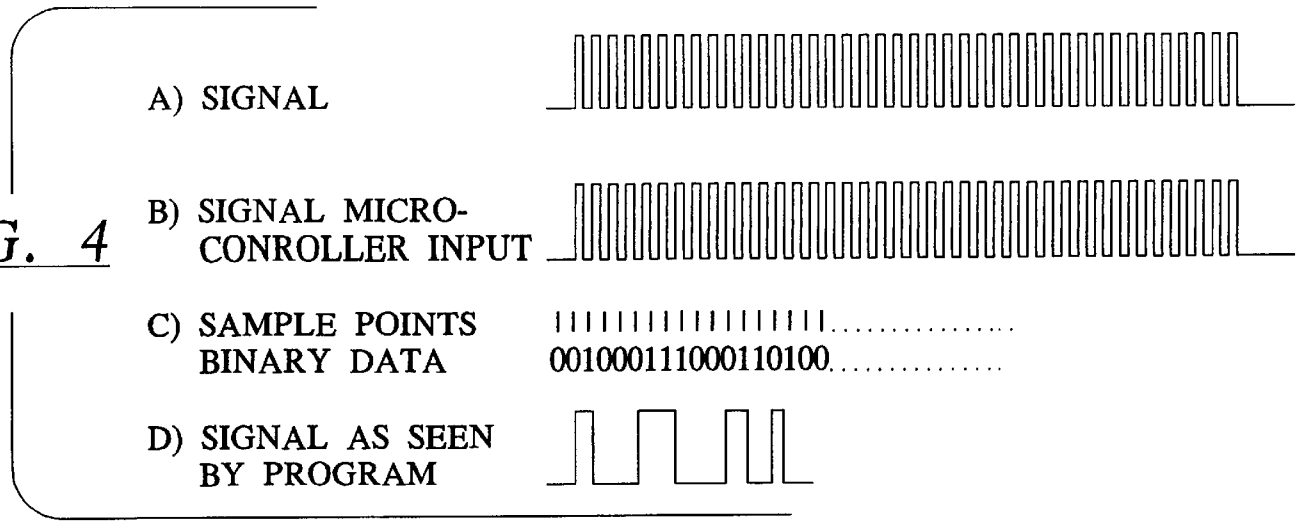
FIG. 4 shows wave forms of a high frequency carrier signal transmitted such as from a television and reconstructed by a high frequency receiver in a remote control device.

Secondly, even if the remote control device 17 is equipped with a high performance receiver circuit, the microcontroller 17 itself may not be able to process the input transitions rapidly enough to obtain an accurate count. This is illustrated in FIG. 4. In this case, even though the high frequency input signal transmitted as shown in FIG. 4A is faithfully reproduced at the microcontroller input, see FIG. 4B, the microcontroller 17 program is unable to process the incoming pulse stream rapidly enough. Accordingly, some of the binary transitions will be missed. This results in an apparent input as shown in FIG. 4D. Obviously, this will in turn cause an incorrect binary count, as indicated in FIG. 4C. A result will be the storage of an incorrect carrier frequency (too low) in the learned code definition.

For the foregoing two reasons, most learning remote control devices are not capable of operating or controlling high frequency devices or equipment.

As alluded to above, the present invention relates to a method of enabling a remote control device to "learn" the coding format of devices operating at high carrier frequencies even though the carrier frequencies cannot be directly processed or measured by the remote control device.

Figure 5:
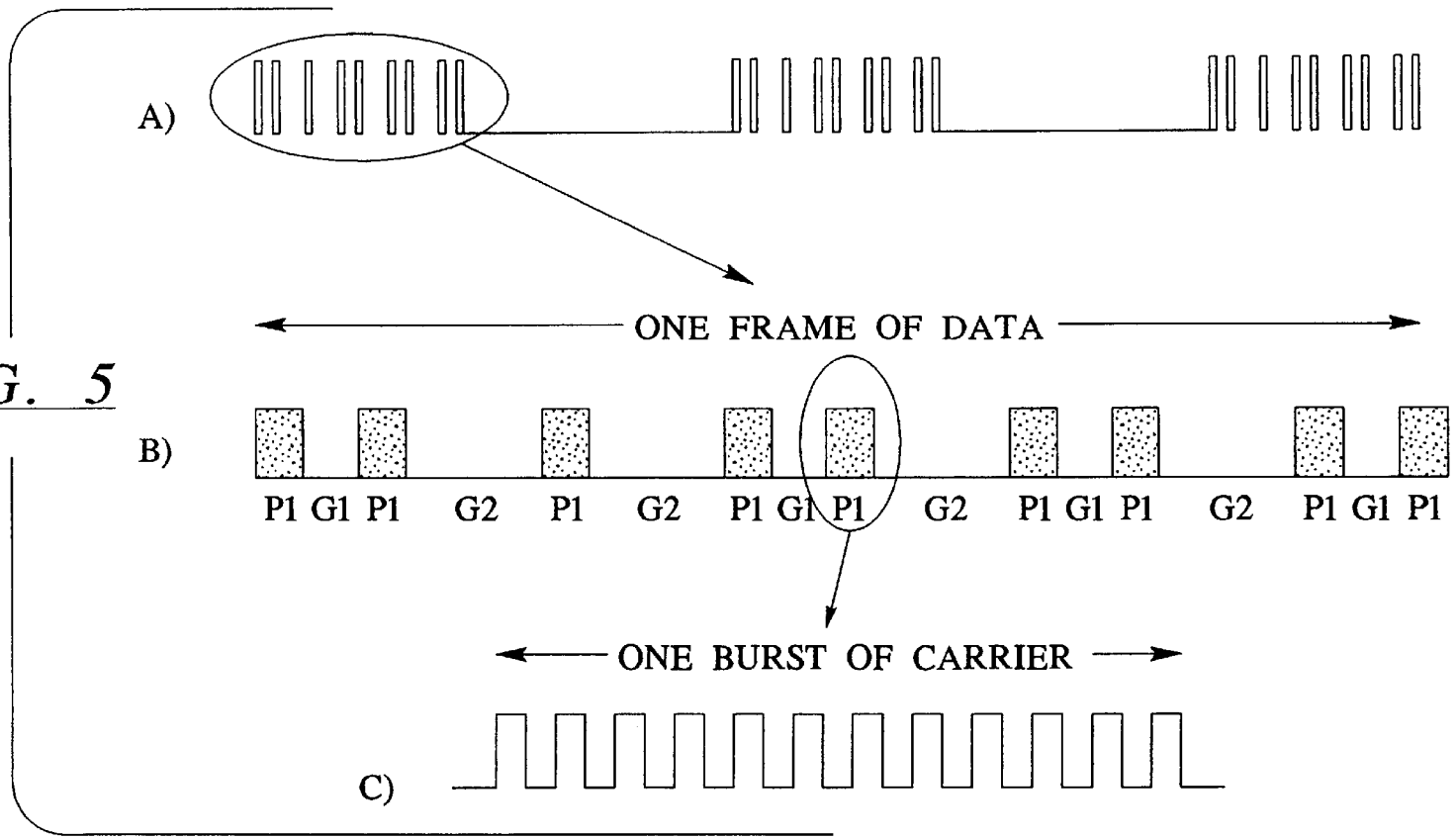
FIG. 5 shows a signal encoding scheme in accordance with the invention.

In many IR transmission schemes the command to be sent is encoded as a train of IR carrier bursts and gaps wherein the variation in burst and/or gap duration is used to represent a string of binary values. These "frames" or groups of data are typically sent repetitively for as long as a key on the remote control is held down. FIG. 5, shows one such scheme wherein eight (8) bits of data are encoded into an IR signaling frame. FIG. 5A depicts several frames of data. FIG. 5B shows a relatively enlarged single frame of FIG. 5A. FIG. 5C shows one burst of the carrier signal. The frame of FIG. 5B comprises a series of fixed length IR bursts P1 with variable gap duration G1 and G2 between them, which is usually called Pulse Position Modulation, or PPM.

Figure 6:
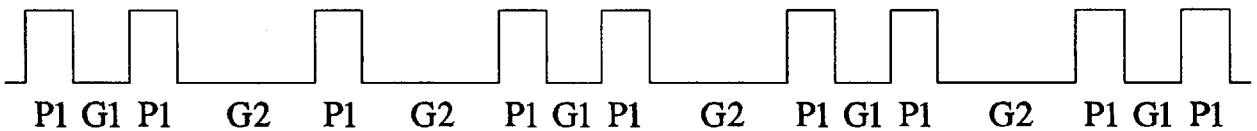
FIG. 6 shows the data frame of FIG. 5 when decoded from a high frequency transmitter; and, FIG. 7 shows a flow chart of the inventive method.

Refer now to FIG. 6 which shows that each "pulse" consists of a burst of IR carrier signal. In this particular scheme, the information content is encoded in the different length of the gaps G1 and G2 between bursts, so it can be seen that the command shown in the example is an eight (8) bit value determined by G1 and G2. If the value "0" is assigned to G1 and the value "1" is assigned to G2, this corresponds to the byte value 01101010, or "6A" in hexadecimal code.

Many other types of pulse based encoding schemes exist, some using variations of PPM encoding, others using schemes in which the burst length is the variable known as Pulse Width Modulation, or PWM. In still other schemes, both parameters are variable. However, in every case the data content of the frame is ultimately represented by a series of burst widths and gap widths.

In order to reproduce this command, a "learning" remote control thus needs to memorize and store:

a) the carrier frequency of the pulses to be sent; and b) the series of burst times, gap times and positions to be used to replicate the pulse train corresponding to one frame of IR data.

In normal operation, with a teaching source using the usual carrier frequencies, the learning software measures the carrier frequency of each burst, as described in conjunction with FIG. 2 above, and stores this data together with the burst and gap timing information. However, when the teaching source is a high frequency device and the learning unit has a receiver characteristic similar to that described above, the learning unit "sees" only the burst/gap envelope of the IR frame, and not the carrier itself.

FIG. 6 illustrates how the signal of the example from FIG. 5 would appear if it were using a high frequency carrier and is decoded by the inventive system. It has been found that the envelope contains information to allow determination of the burst and gap timings even though the carrier frequency remains unknown. Moreover, since the number of different high frequency encoding schemes which a particular learning remote control may be expected to encounter is not large, it is possible to identify these encoding schemes, or at least the most popular of such schemes, by matching characteristic information of the received envelope pattern against the known characteristics of these various high frequency encoding schemes. If a match of characteristic information is found, the carrier frequency to be used when the microcontroller of the remote control device regenerates the signal, can be inferred or deduced. This takes advantage of the characteristics discussed in conjunction with FIG. 3A above. An example of the characteristic information which might be searched against is shown in Table 1 which follows:

TABLE 1

| Number of Bursts Per Frame | Burst Duration #1 | Burst Duration #2 | Gap Duration #1 | Gap Duration #2 | Carrier Frequency |
|---|---|---|---|---|---|
| 12 | 45 | none | 8600 | 5700 | 400 KHz |
| 22 | 220 | none | 6000 | 3000 | 454 KHz |
| 17 | 600 | 1200 | 600 | none | 330 KHz |
| 33 | 500 | none | 500 | 1500 | 1200 KHz |

For example, the entry in a table for the code pattern shown in FIG. 6 would be shown in Table 2 as follows:

TABLE 2

| Number of Bursts Per Frame | Burst Duration #1 | Burst Duration #2 | Gap Duration #1 | Gap Duration #2 | Carrier Frequency |
|---|---|---|---|---|---|
| 9 | P1 | none | G1 | G2 | xxxKHz |

Although the Tables 1 and 2 provide for five characteristic values, that is bursts per frame plus two possibilities, each for burst and gap width, it should be understood that in practice the actual number of parameters used may be adjusted upwards or downwards as necessary to uniquely identify each high frequency code in the set to be supported. In fact, certain parameter types, for example the number of bursts per frame, may be omitted entirely if the remaining items are sufficient to uniquely identify all high frequency codes of interest in a particular application. Also, in some cases, particular burst/gap combinations may occur only in pairs. In the event that all codes of interest exhibit a certain characteristic, these values may be combined in the table and treated as a single entity for the purpose of comparison. This approach is illustrated in Table 3 below:

TABLE 3

| Number of Bursts Per Frame | Burst/Gap Pair #1 | Burst/Gap Pair #2 | Burst/Gap Pair #3 | Carrier Frequency |
|---|---|---|---|---|
| 12 | 45/8600 | 45/5700 | none | 400 KHz |
| 22 | 220/6000 | 220/3000 | none | 440 KHz |
| 17 | 600/600 | 1200/600 | 2400/600 | 300 KHz |
| 33 | 500/500 | 500/1500 | 9000/4500 | 1200 KHz |

Since there are codes in existence which use no carrier at all, "baseband" codes, the algorithm performing the search must default to "no carrier" in the event an appropriate match is not found. The flowchart in FIG. 7 shows how such an envelope pattern recognition process is implemented to support learning of one of a set of high frequency codes, when using the set of example characteristics shown in Table 1 above.

Figure 7:
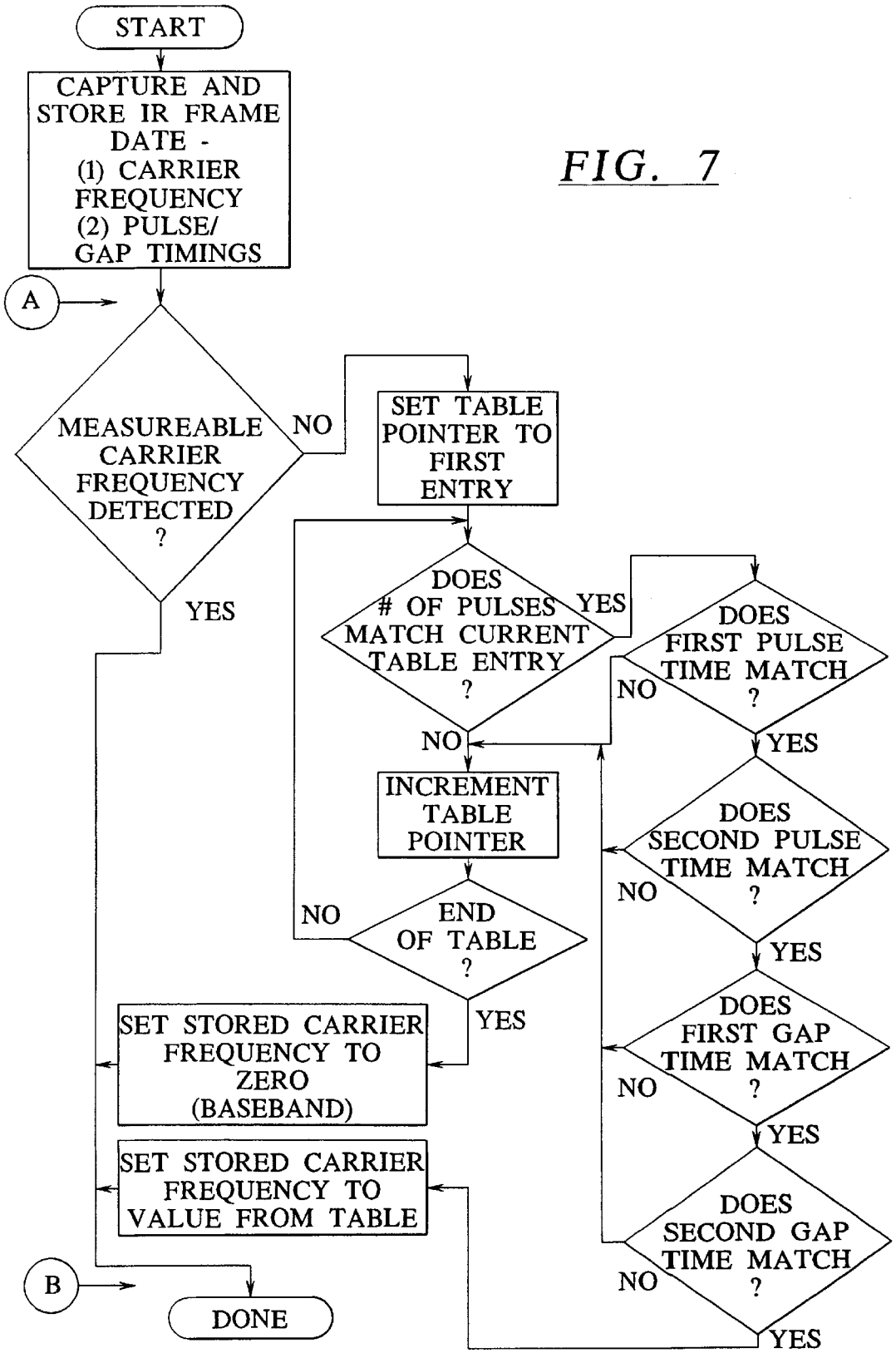

Referring to FIG. 7, the software routine commences by receiving and capturing the IR signal to be learned, using known techniques. The microcontroller stores the values obtained from the carrier frequency and burst/gap durations, which as described earlier are sufficient to fully define the signal to be learned. The microcontroller then checks the status of the carrier information to determine if a measurable carrier frequency value has been detected. If a carrier frequency has been detected, the capture process is complete and no further processing is needed. However, if no carrier frequency is detected, the program then proceeds to match the values obtained for burst/gap durations against the entries in the table. The program thus matches the input parameters with a particular entry in the stored look-up tables and determines the carrier frequency of the input signal. In performing these comparisons, the program allows a useable range or tolerance around the exact table values, typically a tolerance of 1% to 5%, to allow for variations in the capture process.

Thus, if the program finds an entry for which values match within the given tolerance, the program determines that the newly stored carrier frequency is a frequency contained in the table entry. The newly stored carrier frequency is then updated or modified to the frequency of the table entry. If the program finds no match at all, the program assumes that the captured values correspond to a true baseband code and exits with the stored data unchanged.

The characteristic information is thus effectively used to identify the particular equipment to be controlled, and to thereby to infer the carrier frequency to operably control the equipment.

In an alternative embodiment of the invention, the processing steps between points A and B in FIG. 6 can be performed at the time the parameters are retrieved from storage to regenerate the signal for transmission, rather than at the time they were originally stored. This technique has the added advantage that it can be applied to data which was previously captured by other devices which did not include this algorithm, or were not equipped with suitable table values.

A further modification of the system comprises a learning remote control device in which the table data for identifying high frequency devices is contained in the read/write memory of the microcontroller 17 and this can be updated to extend the range of high frequency the system can learn to control.

While the invention has been particularly shown and described with reference to a particular embodiment thereof it will be understood by those skilled in the art that various changes in form and detail may be made therein without departing from the spirit and scope of the invention.

What is claimed is:

1. A remote control system for learning respective sets of characteristic information of signals of a plurality of respective devices to be controlled, said system comprising:

a) a microcontroller;

b) a receiver for receiving signals from the devices, the receiver connected to the microcontroller;

c) program means for analyzing a signal for controlling one of the plurality of devices and providing a set of characteristic information for the signal, wherein the characteristic information of the signal comprises a carrier frequency parameter and other parameters;

d) means for storing sets of characteristic information of known signals;

e) means for comparing the set of characteristic information of the signal with the stored sets of characteristic information of known signals, wherein the means for comparing comprises programming for determining if the carrier frequency parameter of the signal is zero and if the carrier frequency parameter is zero, then comparing the other parameters with the sets of characteristic information of known signals; and, f) means for modifying the set of characteristic information of the signal to match one of the stored sets of characteristic information of known signals.

2. The system of claim 1 wherein the set of characteristic information for the signal comprises a carrier frequency parameter, a carrier frequency burst width parameter and a carrier frequency gap width parameter.

3. The system of claim 2 wherein the characteristic information includes a number of carrier frequency bursts per transmission frame parameter.

4. The system of claim 1 wherein an infrared (IR) device provides the signal for the device to be controlled to the receiver.

5. A system for receiving and analyzing characteristic information of coded transmissions from a plurality of devices to an IR remote control, said system comprising:

a) a microprocessor;

b) a receiver connected to receive the coded transmissions and to provide an input to said microprocessor wherein said microprocessor analyzes said input and develops input characteristic information of one of the coded transmissions;

d) a look-up table including characteristic information of coded transmissions for controlling at least one of the plurality of devices;

e) means for comparing the input characteristic information of the coded transmission to the characteristic information in the look-up table; and f) means for modifying the input characteristic information of the coded transmission to match characteristic information in the look-up table if the input characteristic information is determined to be within a set range, and for providing no change to the input characteristic information if the input characteristic information is not within the set range.

6. The system of claim 5 wherein the characteristic information of coded transmissions for controlling at least one device comprises a carrier frequency parameter, a carrier frequency burst width parameter and a carrier frequency gap width parameter.

7. The system of claim 5 wherein an infrared (IR) remote control device provides transmissions to the receiver.

8. The system of claim 1 wherein proramming means infers carrier frequency values of the signal which lie outside of a direct determination measurement range by analyzing other input characteristic information.

9. The system claim 1 wherein a carrier frequency parameter is inferred by comparing other characteristic information to corresponding characteristic information of known high frequency signals.

10. The system of claim 1 including means to regenerate and transmit the signal for controlling the one of the plurality of devices.

11. A method for reproducing control codes from stored data, the method comprising the steps of creating control codes in response to a comparison of input data with stored data, regenerating and transmitting an original signal, determining a carrier frequency based on characteristic information of the original signal if the carrier frequency is within a capture range of a receiving system, otherwise determining the carrier frequency of the original signal from other parameters of the original signal.

12. The system of claim 1, comprising means for regenerating the signal from the set of characteristic information.

13. The system of claim 1, wherein the one of the plurality of devices to be controlled operates at a high frequency and the signal comprises a carrier having a frequency of at least 100 KHz.

14. A reconfigurable remote control comprising:

a) a receiver for receiving a signal wherein the signal includes characteristic information values, including a carrier frequency value;

b) programming operable with the receiver for capturing the signal;

c) a microcontroller operable with the receiver for storing the signal characteristic information values;

d) memory including a plurality of entries comprising signal characteristic information parameters; and e) programming for comparing the signal characteristic information values with the signal characteristic information parameters in memory and for determining the carrier frequency value of the signal.

15. The remote control of claim 14, comprising programming for modifying the carrier frequency value of the signal to match a carrier frequency parameter of one of the entries of signal characteristic information parameters, wherein the carrier frequency value of the signal, prior to modification, is within a predetermined range of the carrier frequency parameter.

16. A method of reconfiguring a remote control adapted to learn transmission codes for controlling a plurality of devices, the method comprising the steps of:

a) checking a status of carrier frequency to determine if a measurable carrier frequency value has been detected;

b) if no measurable carrier frequency is detected, then attempting to match signal characteristic values with stored signal characteristic parameters; and c) if a match between the values and the parameters is found, determining a carrier frequency.

17. The method of claim 16, comprising the step of processing a transmission code to be learned as a true baseband code if an insufficient match between the values and the parameters is found.

18. The method of claim 16, comprising the step of modifying the signal characteristic values prior to storing the values in memory.

19. The method of claim 16, comprising the step of retrieving the signal characteristic values from memory prior to comparing the values with the parameters stored in memory.

20. The method of claim 16, wherein the stored signal characteristic parameters correspond to signals for controlling high frequency devices.

21. The method of claim 16, comprising the step of storing the signal characteristic parameters in a read/write memory of a microcontroller.

22. A remote control system for learning respective sets of characteristic information of signals of a plurality of respective devices to be controlled, said system comprising:

a microcontroller;

a receiver for receiving signals from the devices, the receiver connected to the microcontroller;

program means for analyzing a signal for controlling one of the plurality of devices and providing a set of characteristic information for the signal;

means for storing sets of characteristic information of known signals;

means for comparing the set of characteristic information of the signal with the stored sets of characteristic information of known signals; and, means for determining the signal based upon the comparison of the set of characteristic information with the stored sets of characteristic information of known signals.

23. The system of claim 22, wherein the set of characteristic information of the signal comprises fewer parameters than at least one of the stored sets of characteristic information of known signals.

24. A remote control system for learning respective sets of characteristic information of signals of a plurality of respective devices to be controlled, said system comprising:

a microcontroller;

a receiver for receiving signals from the devices, the receiver connected to the microcontroller;

program means for analyzing a signal for controlling one of the plurality of devices and providing a set of characteristic information for the signal;

means for storing sets of characteristic information of known signals;

means for comparing the set of characteristic information of the signal with the stored sets of characteristic information of known signals; and, means for adjusting the set of characteristic information of the signal based upon the comparison of the set of characteristic information with the stored sets of characteristic information of known signals.

25. A reconfigurable remote control comprising:

a receiver for receiving a signal wherein the signal includes characteristic information values;

programming operable with the receiver for capturing the signal;

a microcontroller operable with the receiver for storing the signal characteristic information values;

memory including a plurality of entries comprising signal characteristic information parameters; and programming for comparing the signal characteristic information values with the signal characteristic information parameters in memory and for determining the signal.

26. The control of claim 25, wherein the characteristic information values are fewer in number than the signal characteristic information parameters of at least one of the entries of such parameters.

27. A control comprising:

memory including a plurality of entries comprising signal characteristic information parameters; and programming for comparing at least one of the entries of signal characteristic information parameters with characteristic information values of a received signal.

28. The control of claim 27, wherein the number of values of the characteristic information of the received signal are fewer than the number of parameters of the at least one entry of signal characteristic information.

* * * * *